US007914342B2

(12) United States Patent
Chen

(10) Patent No.: US 7,914,342 B2
(45) Date of Patent: Mar. 29, 2011

(54) SIGNAL PLUG

(76) Inventor: Ching-Fu Chen, Luju Township, Taoyuan County (TW)

( * ) Notice: Subject to any disclaimer, the term of this patent is extended or adjusted under 35 U.S.C. 154(b) by 0 days.

(21) Appl. No.: 12/456,149

(22) Filed: Jun. 15, 2009

(65) Prior Publication Data

US 2010/0317238 A1 Dec. 16, 2010

(51) Int. Cl.
*H01R 13/625* (2006.01)

(52) U.S. Cl. ..... 439/669

(58) Field of Classification Search ..... 439/669, 439/668, 817, 357, 842–850
See application file for complete search history.

(56) References Cited

U.S. PATENT DOCUMENTS

| | | | | | |
|---|---|---|---|---|---|
| 1,410,297 | A * | 3/1922 | Harman | ..... | 200/61.26 |
| 2,434,070 | A * | 1/1948 | Gross | ..... | 310/34 |
| 2,469,274 | A * | 5/1949 | Rein | ..... | 200/314 |
| 5,308,266 | A * | 5/1994 | Booker | ..... | 439/817 |
| 5,569,053 | A * | 10/1996 | Nelson et al. | ..... | 439/668 |
| 7,699,665 | B1 * | 4/2010 | Yin | ..... | 439/669 |

* cited by examiner

*Primary Examiner* — Jean F Duverne
(74) *Attorney, Agent, or Firm* — Bacon & Thomas, PLLC

(57) ABSTRACT

This invention is a kind of signal plug, mainly comprising of a body and a sleeve. On the front of the body there is a C-shaped section contact pin and on the end, there is a positioning device and conducting wire anchor parts. The sleeve comprises of a hole passing through it, a positioning part and joining screw guide hole. These components combined make plug assembly convenient and make wiring connecting easier and safer, and, moreover, increase the signal conductivity of the main body because the contact pin to the conducting wire anchor parts is a one piece design.

7 Claims, 15 Drawing Sheets

SIGNAL PLUG

BACKGROUND OF THE INVENTION

1. Field of the Invention

This invention is a kind of signal plug, specifically one that makes signal plug assembly more convenient and provides improved signal conductivity.

2. Description of the Prior Art

As shown in FIG. 1 conventional signal plugs 10 have a banana plug 100 and an insulation shell 101; the banana plug 100 can be inserted into the connecting hole of the signal plug socket joining the two and allowing flow.

As shown in FIG. 2, the signal plug 11 includes an outer casing 111, cable holder 112, contact pin 113 and anchor part 114. Signal plug 11 can also be plugged into the connecting hole in the banana socket connecting them and allowing flow.

As shown in FIG. 3, in order to increase conventional signal contact body parts safety and meet the BFA (British Federation of audio) standards, a new conventional signal contact body parts, namely an improved banana plug connector inverted inside the plug were developed. As shown in FIG. 3, the conventional signal female plug 12 includes a cable holder 120, an outer casing 121, joining pipe 122, contact pin 123 and anchor part 124. Joining pipe 122, contact pin 123 of the conventional signal female plug 12 can be inserted into its outer protective tube with the contact pin 123 fitted on the BFA (British Federation of audio) socket that signals pass between them.

The connector between cable holder 120 of the signal female plug 12 and contact pin 123 is a secondary contact which will increase its resistance. Also, the cost of the copper material that cable holder 120 is made of is also high. The fitting of the signal wire is very inconvenient because the outer casing 121 has to be removed for the signal wire to be connected to the cable holder 120, making use inconvenient.

SUMMARY OF THE INVENTION

The main objective of this invention is to provide a signal plug that is easy to assemble and has excellent signal conductivity.

The main characteristic of this invention is the body has a flexible contact pin on the front and on the end, there is a positioning device and conducting wire anchor parts. The sleeve has a hole passing through it and has a positioning part and joining screw guide hole.

BRIEF DESCRIPTION OF DRAWINGS

This invention is better understood by referring to the accompanying drawings, wherein.

DETAILED DESCRIPTION OF THE PREFERRED EMBODIMENT

Figure 1B:
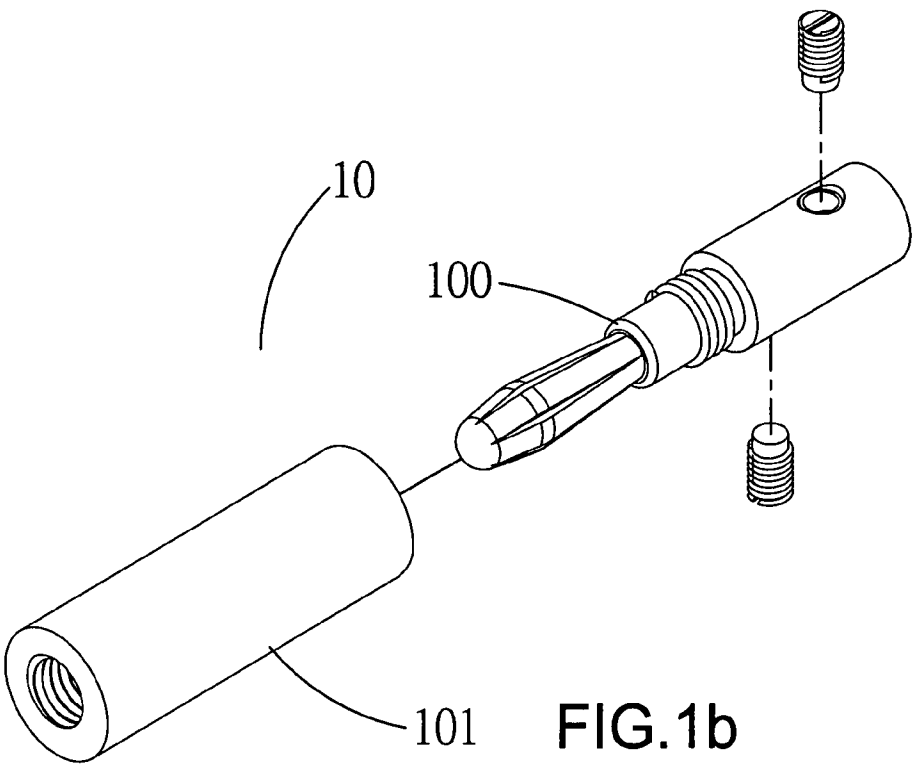
FIG. 1*b* is an exploded view of FIG. 1*a;*
Figure 1A:
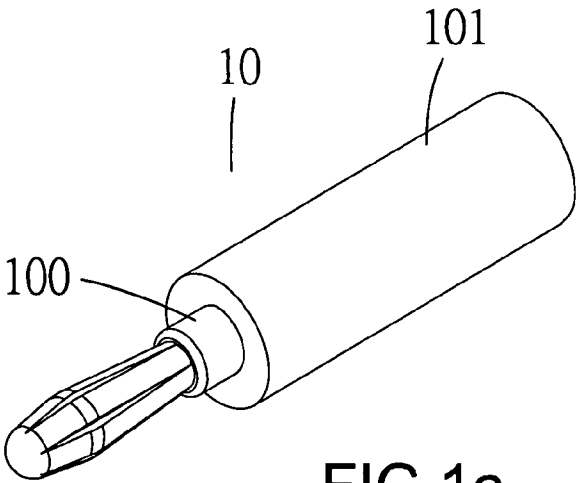
FIG.1a (PRIOR ART)
FIG. 1*a* is a perspective view of a conventional signal plug.
Figure 2B:
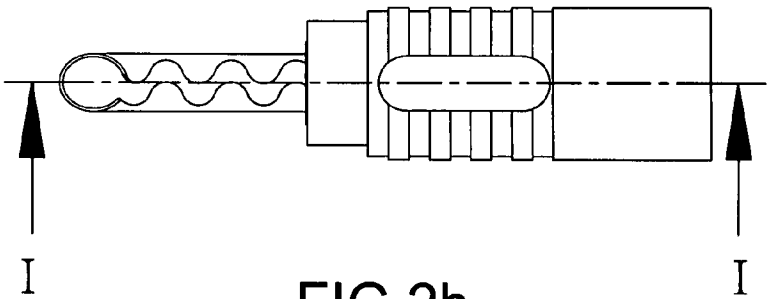
FIG. 2*b* is a top view of FIG. 2*a;*
Figure 2C:
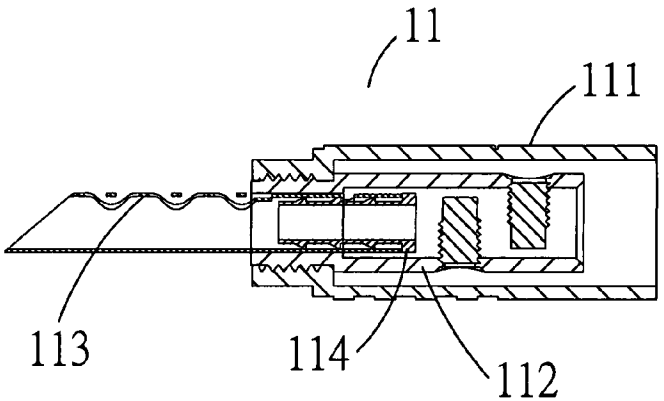
FIG. 2*c* is cross-sectional view of a line I-I in FIG. 2*b;*
Figure 2A:
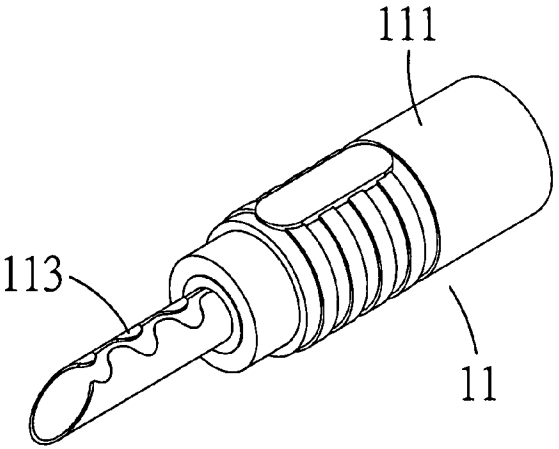
FIG.2a (PRIOR ART)
FIG. 2*a* is a perspective view of a conventional signal plug.
Figures 3A, 3B:
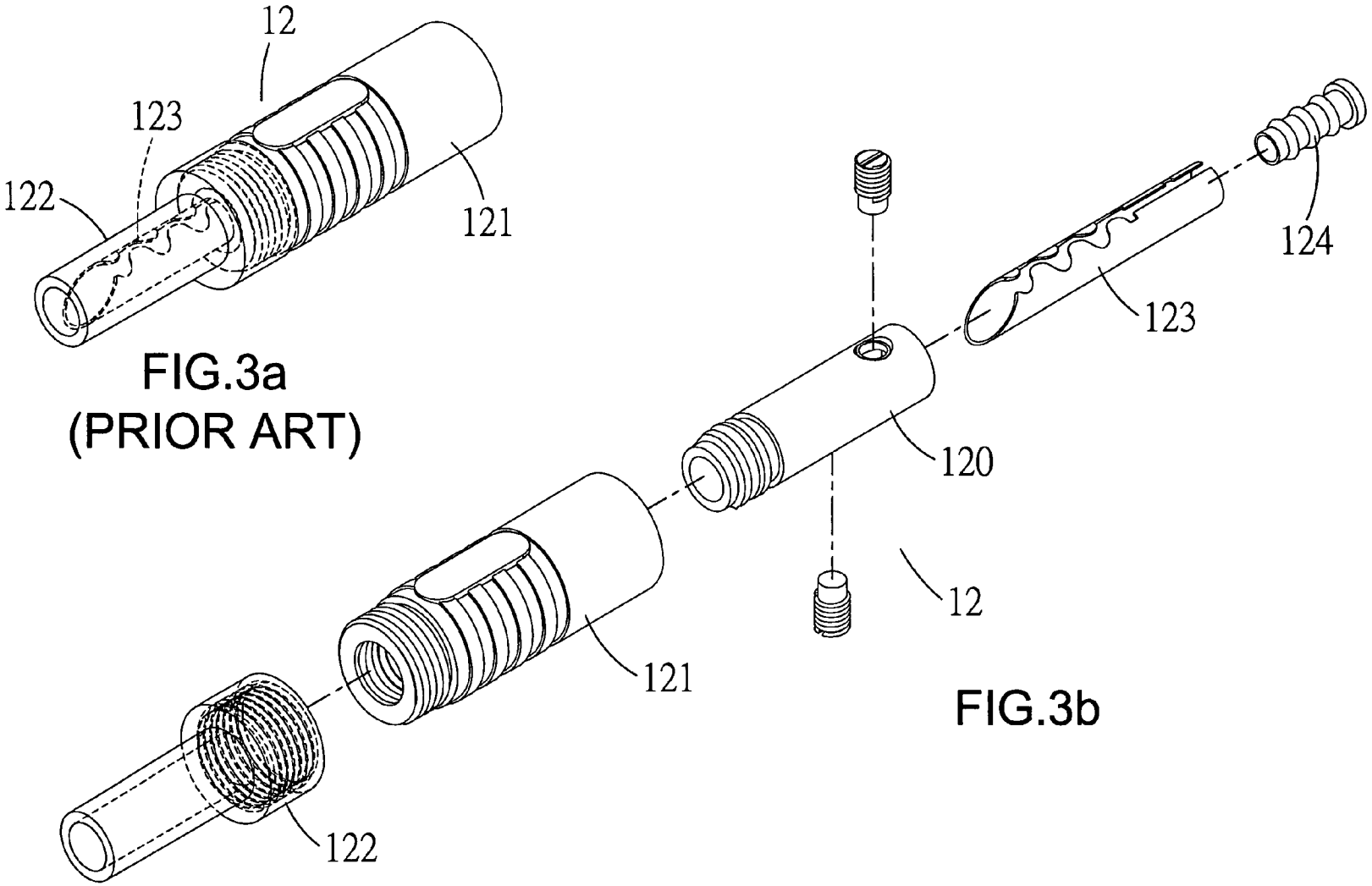
FIG.3a (PRIOR ART)
FIG. 3*a* is a perspective view of applicable to the UK BFA's signal plug.
FIG. 3*b* is an exploded view of shown in FIG. 3*a;*
Figure 4:
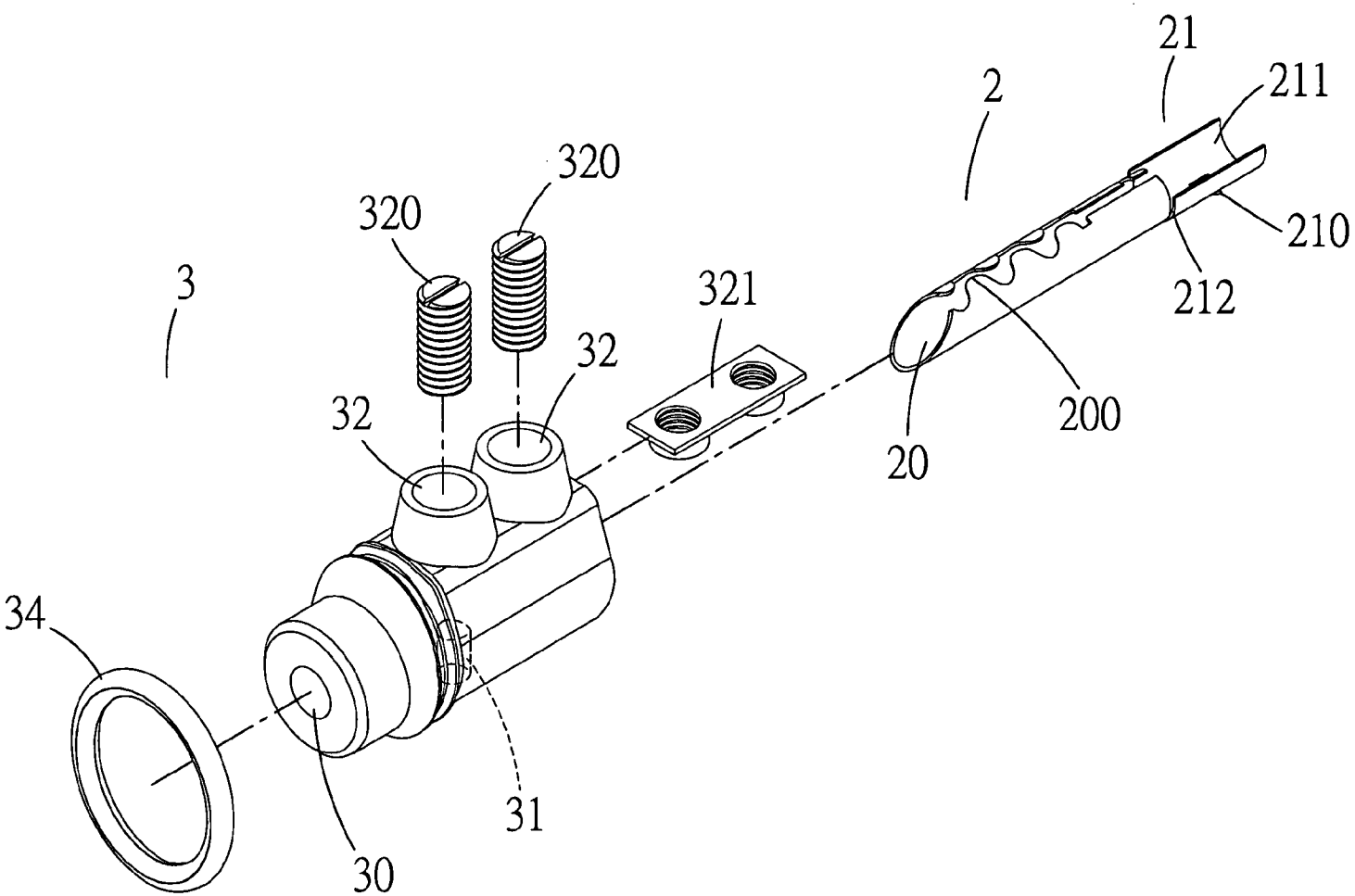
FIG. 4 is an exploded view of the first embodiment of the present invention.
Figure 5:
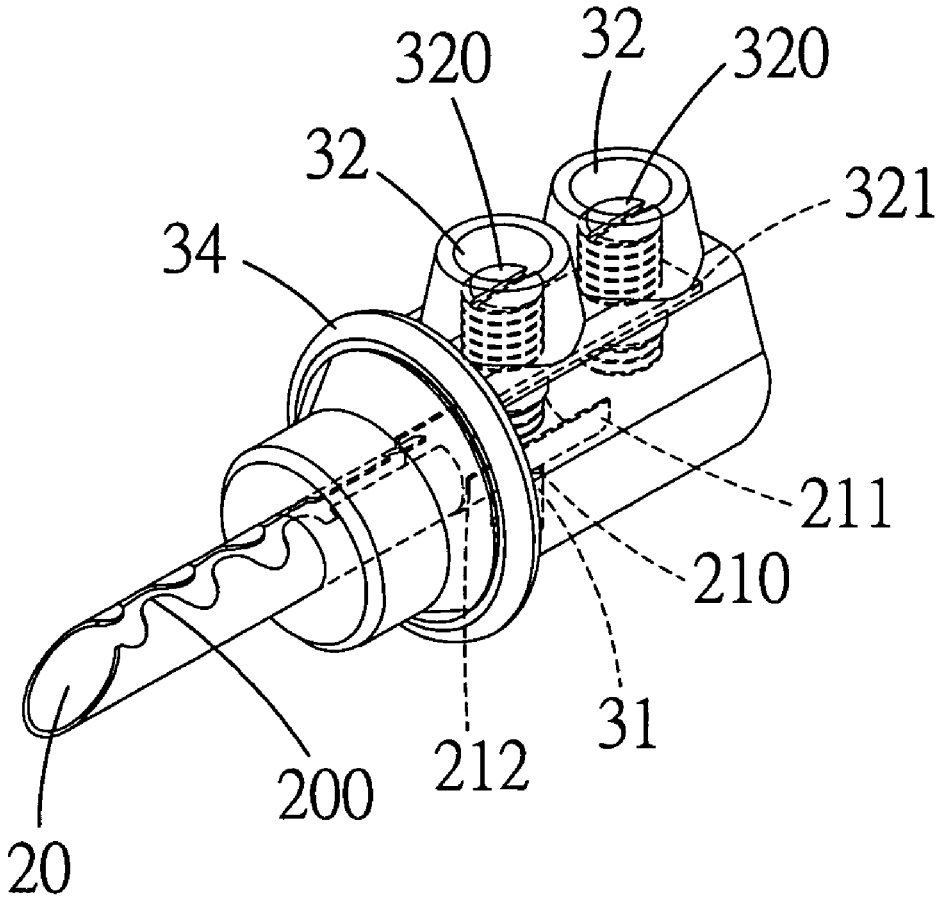
FIG. 5 is a perspective view of the first embodiment of the present invention.
Figure 6:
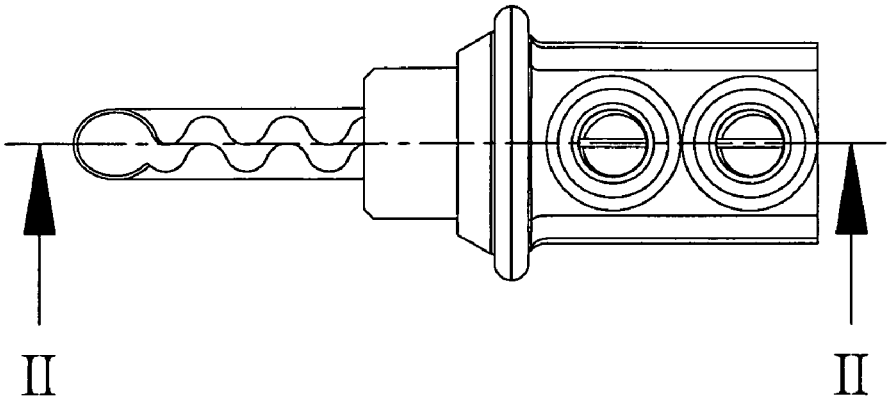
FIG. 6 is cross-section view taken a line II-II.
Figure 6:
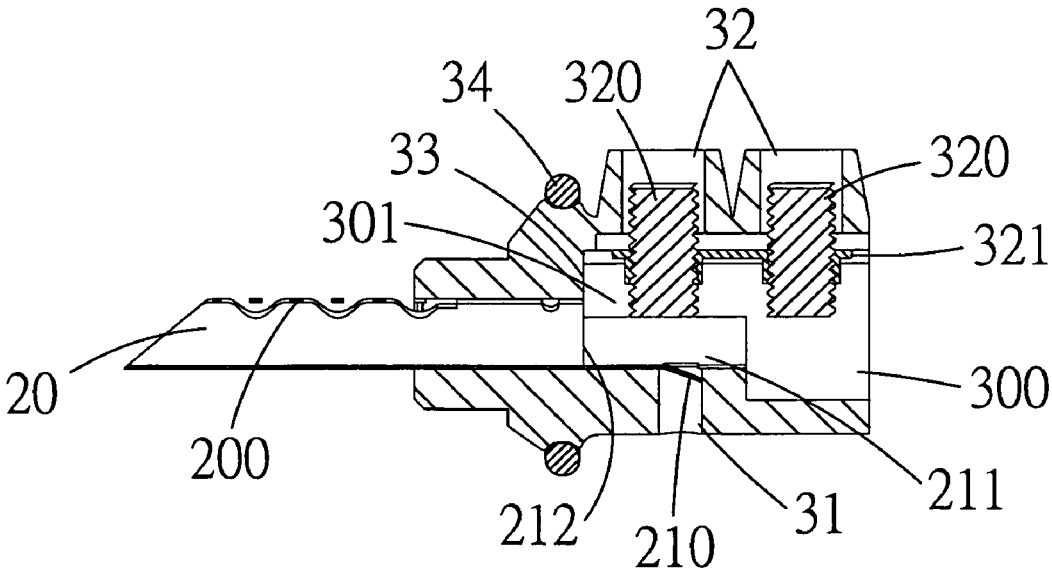

As is shown in FIGS. 4~6, the first embodiment of this invention comprises mainly of a main body 2 and a sleeve 3. On the front of the main body 2 there is a C-shaped section contact pin 20 on which there is an elastic edge 200 with a gap. At the end of main body 2 there is a concave part 21 on which there is a positioning device 210, conducting wire anchor parts 211 and stopper tag 212. Positioning device 210 comprises of a clip-in shell fragment or reverse tapered teeth. Sleeve 3 has a hole 30 through it. The hole 30 has a step shaped large and small circular groves 300, 301 and there is a positioning part 31, joining screw guide hole 32 and plate 33 on the front of the sleeve 3. Joining screw guide hole 32 has screw joint parts 320-321. On the top of sleeve 3 there is a polar color ring 34.

When assembling, the main body 2 is inserted through the large circular grove 300 on the end of sleeve 3 and contact pin 20 on main body 2 passes through hole 30. When main body 2 reaches the plate 33 of the sleeve and slots into stopper tag 212, positioning device 210 inserted into the positioning part 31 of sleeve 3. This fixed main body 2 inside sleeve 3 and completes assemble.

Figure 7:
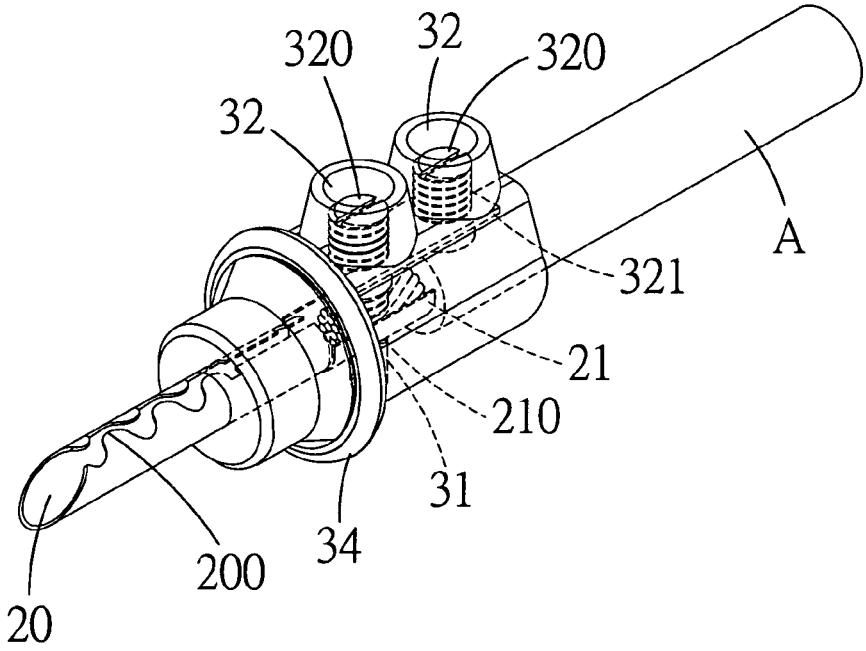
FIG. 7 is a perspective view of the signal plug of using condition in the present invention.
Figure 8:
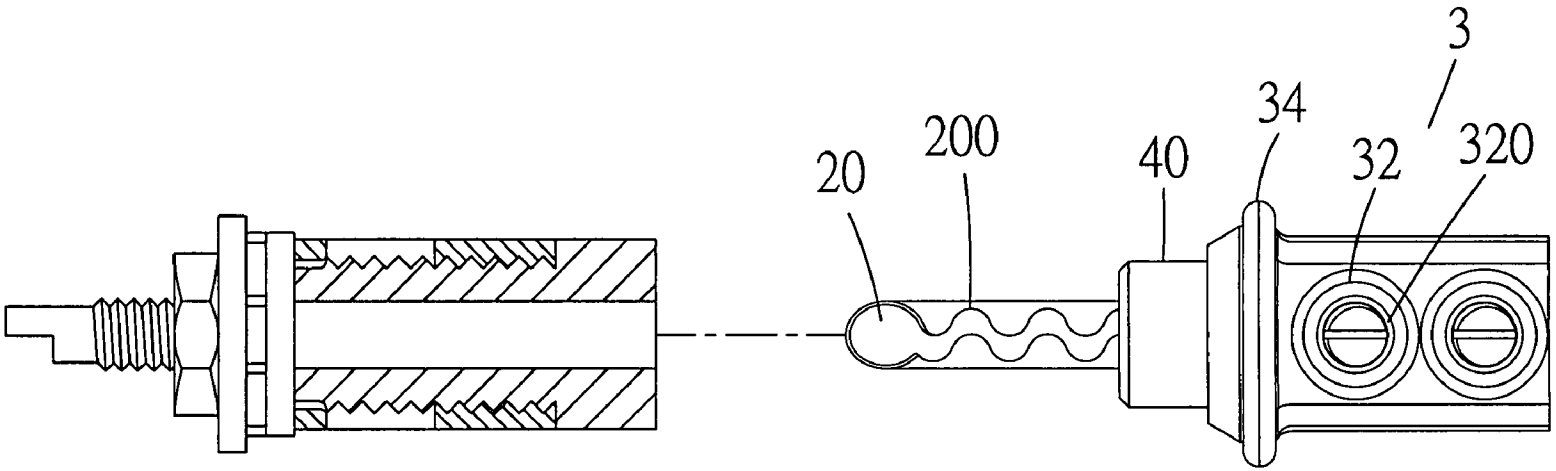
FIG. 8 is an exploded view of the first embodiment of the present invention and a partial section of a conventional banana socket.
Figure 9:
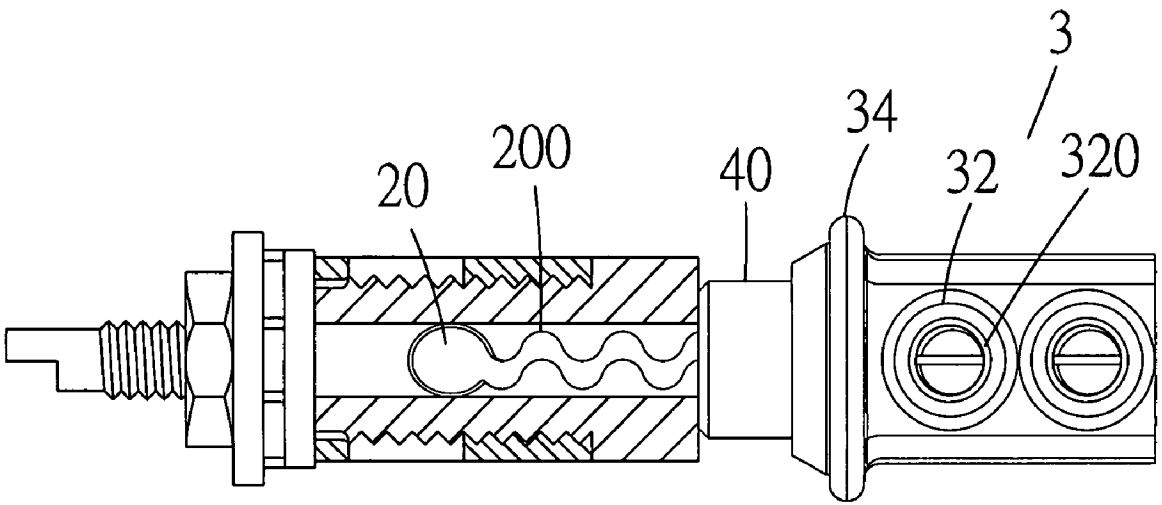
FIG. 9 is a partial cross-sectional view of the first embodiment of the present invention plugged into a conventional banana socket.

When installing signal conducting wire (A), all that needed is to pass it through the large circular grove 300 on the end of sleeve 3 and then screw the conducting wire (A) is place using joining screw guide hole 32 and screw joint parts 320 and 321 to fix on conducting wire anchor parts 211 (as shown in FIG. 7), easily completing wire installation and then the present invention can be plugged into a conventional signal socket (as shown in FIGS. 8 to 9).

Figure 10:
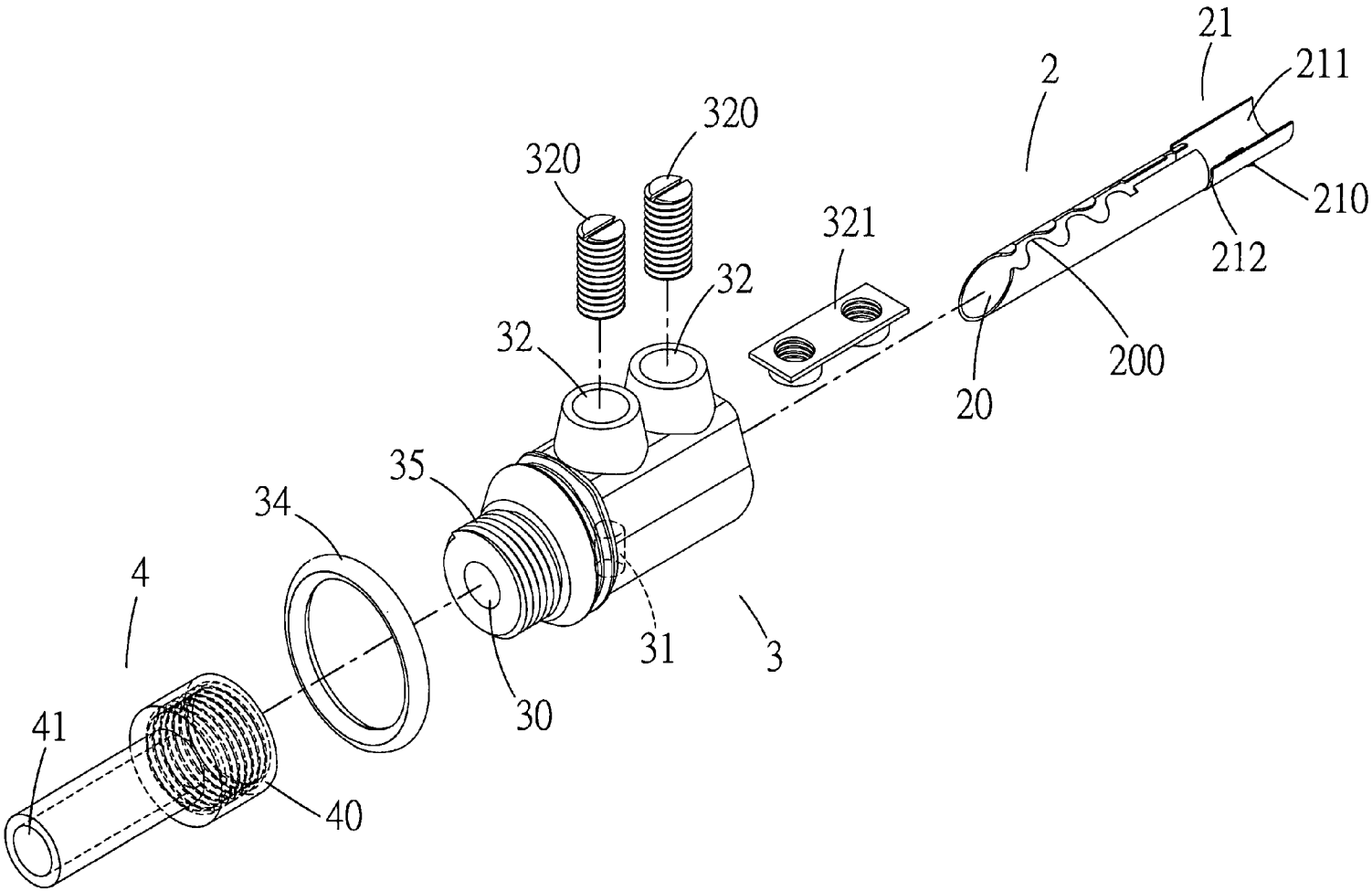
FIG. 10 is an exploded view of the second embodiment of the present invention.
Figure 11:
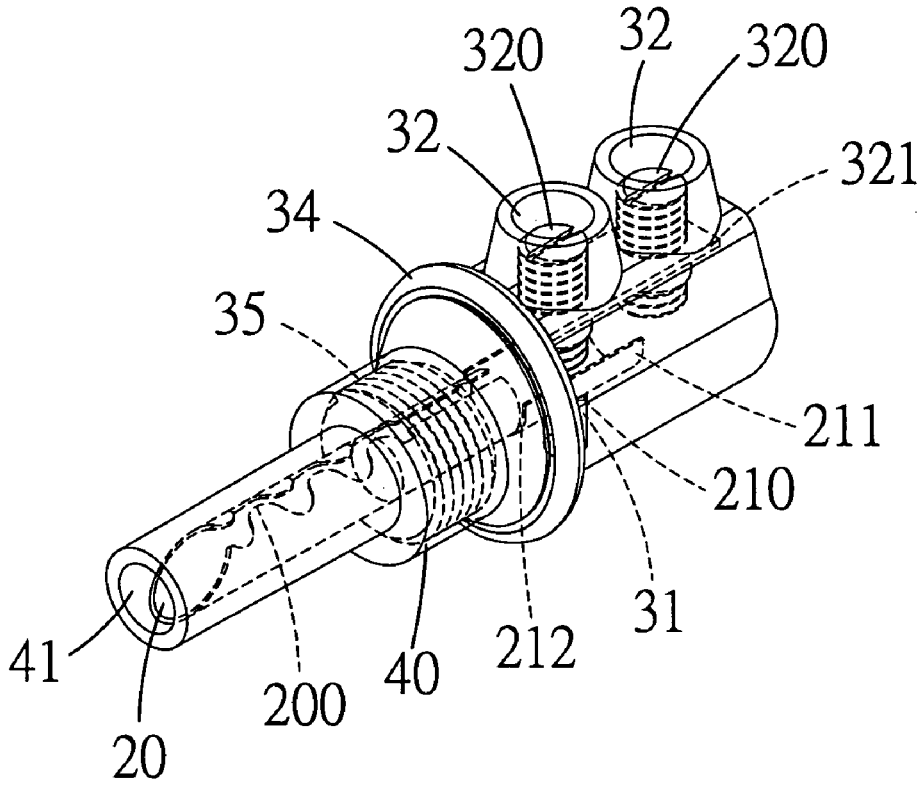
FIG. 11 is a perspective view of the second embodiment of the present invention.
Figure 12:
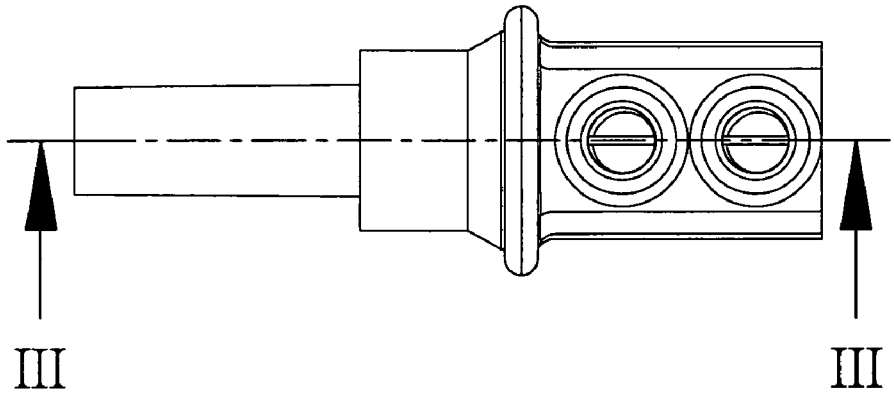
FIG. 12 is cross-sectional view taken a line III-III.
Figure 12:
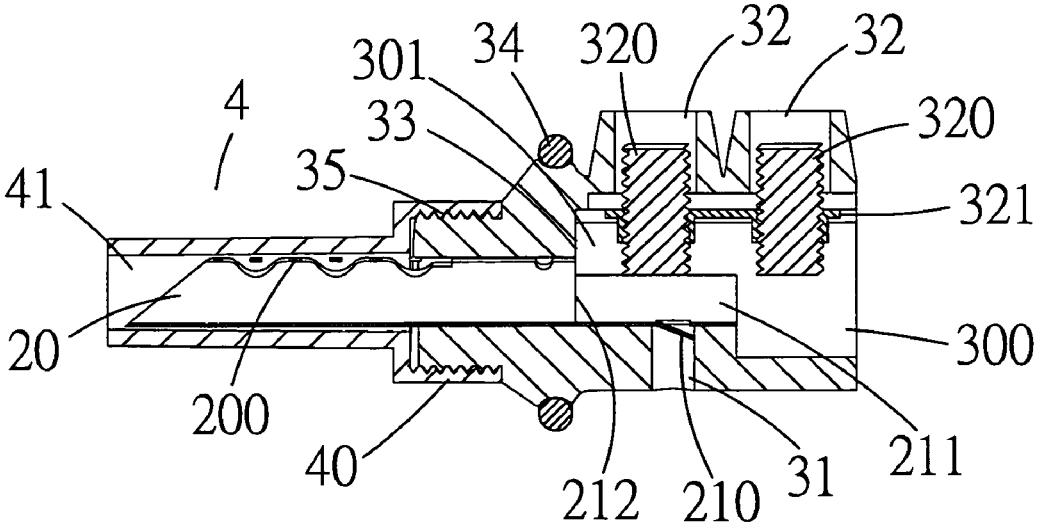

As shown in FIGS. 10~12, the second embodiment of this invention comprises mainly of a main body 2, a sleeve 3 and a Safety casing 4. On the front of the main body 2 there is a C-shaped section contact pin 20 on which there is an elastic edge 200 with a gap. At the end of main body 2 there is a concave part 21 on which there is a positioning device 210, conducting wire anchor parts 211 and stopper tag 212. Positioning device 210 comprises of a clip-in shell fragment or reverse tapered teeth. Sleeve 3 has a hole 30 through it. The hole 30 has a step shaped large and small circular groves 300, 301 and there is a positioning part 31, joining screw guide hole 32 and plate 33 on the front of the sleeve 3. Joining screw guide hole 32 has screw joint parts 320-321. There is a polar color ring 34 and registration part 35 on the front of the sleeve 3. Safety casing 4 is a hollow tube shaped. On the end of safety casing 4 with the largest diameter there is a joining part 40 and annular tuber 41. Joining part 40 can be threaded.

When assembling, the main body 2 is inserted through the large circular grove 300 on the end of sleeve 3 and contact pin 20 on main body 2 passes through hole 30. When main body 2 reaches the plate 33 of the sleeve 3 and slots into stopper tag 212, positioning device 210 inserted into the positioning part 31 of sleeve 3. Then, insert safety casing 4 into main body 2's contact pin 20, fitting joining part 40 and registration part 35 on sleeve 3 together, thus completing assembly. The plug can then be used in accordance with UK BFA (British Federation of audio) standards and when the safety casing 4 is removed it can be used as a normal banana plug.

Figure 13:
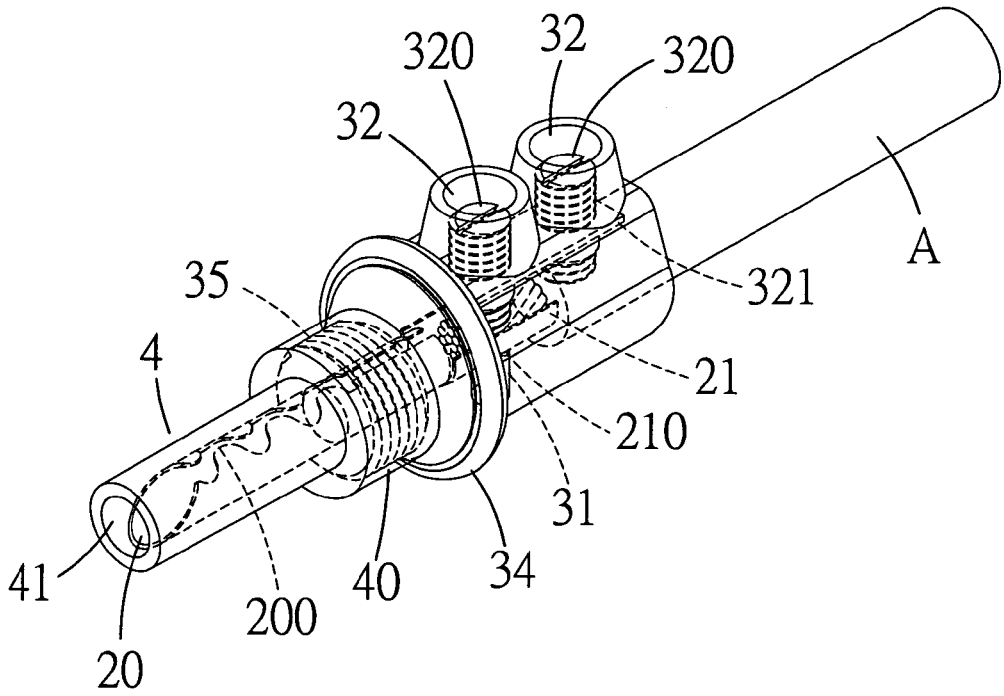
FIG. 13 is a perspective view of the signal plug of using condition in the present invention.
Figure 14:
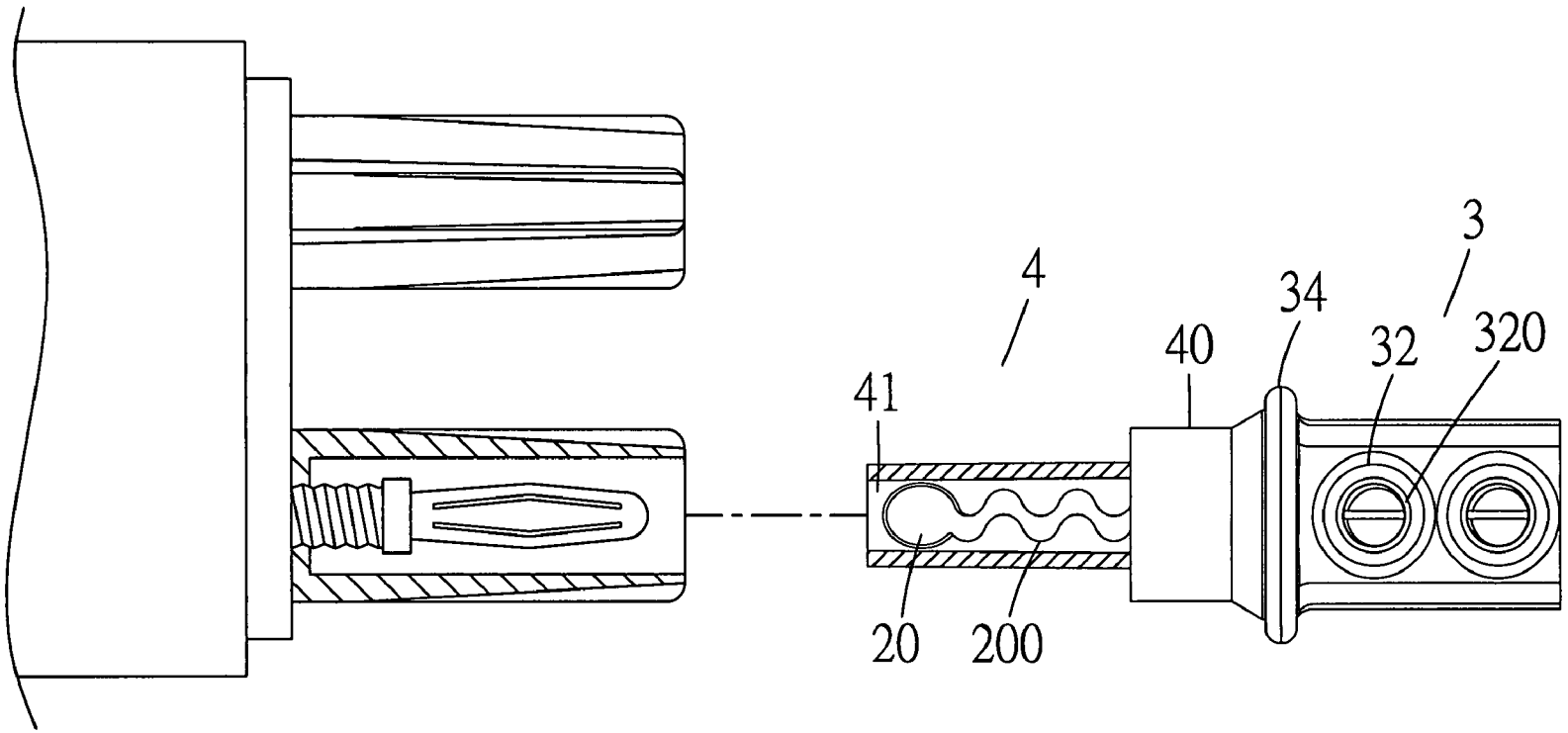
FIG. 14 is an exploded view of the second embodiment of the present invention and a UK BFA's signal socket.
Figure 15:
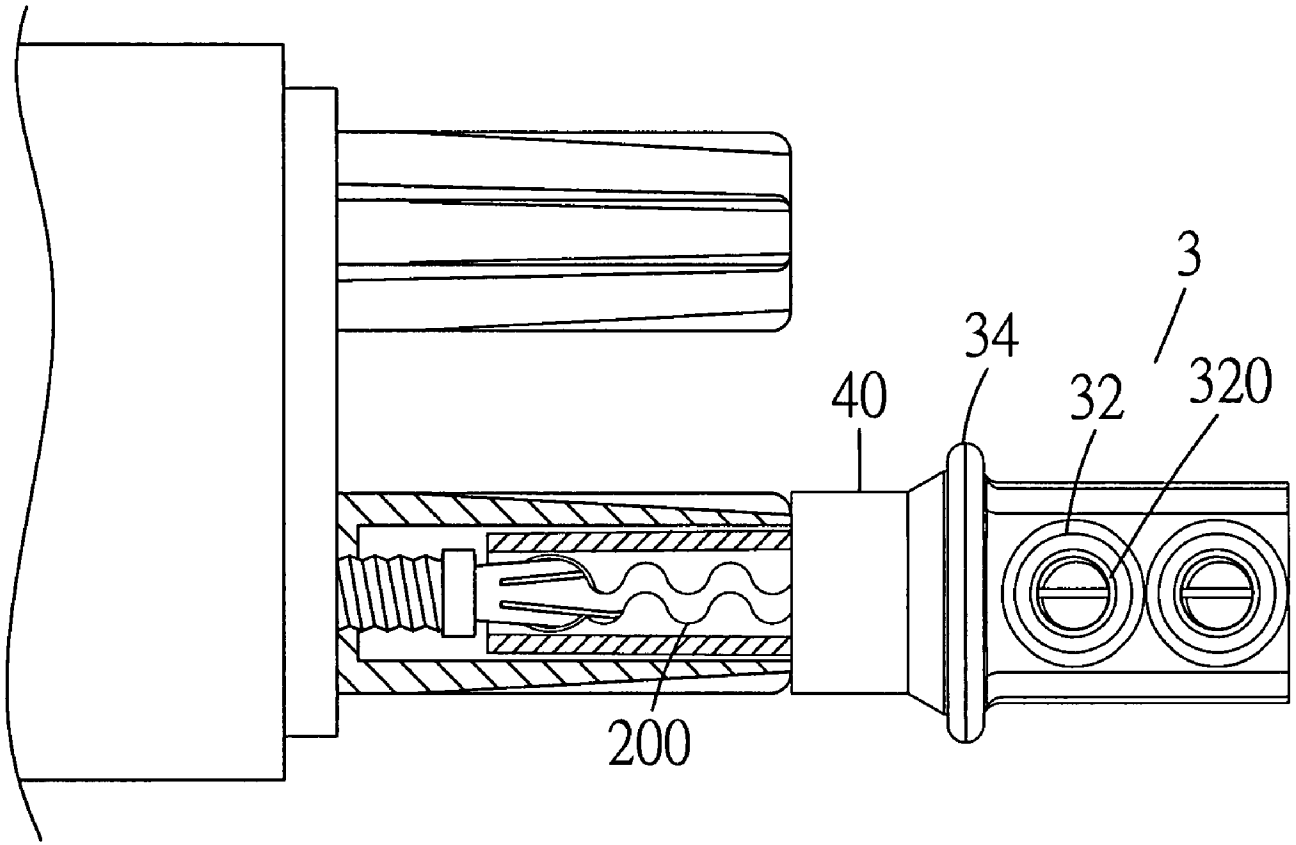
FIG. 15 is a partial cross-sectional view of the second embodiment of the present invention plugged into a UK BFA's signal socket.

When installing signal conducting wire (A), all that needed is to pass it through the large circular grove 300 on the end of sleeve 3 and then screw the conducting wire (A) is place using joining screw guide hole 32 and screw joint parts 320 and 321 to fix on conducting wire anchor parts 211 (as shown in FIG. 13). The present invention plugged into a BFA (British Federation of audio) signal socket (as shown in FIGS. 14 to 15).

The above explanation shows that this invention has the following advantages:

1. This signal plug is convenient to assemble.
2. This signal plug allows material cost savings to be made.
3. This signal plug has a single conductor and high conduction, conducting electricity more smoothly so there is no extra resistance because of secondary contact.
4. This signal plug is convenient to use and the wire can be fixed using a screw without moving the outer casing.
5. This invention's main body 2 and sleeve 3 are assembled by fitting together positioning part 31 and plate 33 on the sleeve 3 and positioning device 210 and stopper tag 212, making the wire on the concave part 21 on main body 2 stable, preventing it sliding or becoming detached.
6. This invention's main body 2 has an elastic edge 200 that effectively holds and penetrates the terminal, completely covering it, making signal transmission between the terminal and main body 2 more accurate and stable.

While the preferred embodiment of the invention has been described above, it will be recognized and understood that various modifications may be made therein and the appended claims are intended to cover all such modifications that may fall within the spirit and scope of the invention.

What is claimed is:

1. A flexible and easy to assemble signal plug comprising:
- a main body comprising a front having a flexible contact pin which has an elastic edge with a gap, and
- an end having a concave part which has a positioning device, conducting wire anchor parts, and a stopper tag, wherein the positioning device comprises a clip-in shell fragment or reverse tapered teeth; and
- a sleeve having a front having a positioning part, plate, and joining screw guide hole and another hole, wherein said another hole has step shaped large and small circular grooves.

2. The signal plug as claimed in claim 1, wherein the contact pin has a C-shaped wavy surface providing a good elastic cover.

3. The signal plug as claimed in claim 1, wherein the positioning device is fragment shaped allowing it to be easily inserted into the holding part of the sleeve and be easily fixed in position.

4. The signal plug as claimed in claim 1, wherein the hole through the sleeve has ladder shaped large and small circular grooves that form the plate for a stopper tag of the main body.

5. A signal plug mainly comprising:
- a main body comprising a front having a flexible contact pin which has an elastic edge with a gap, and
- an end having a concave part which has a positioning device, conducting wire anchor parts, and a stopper tag, wherein the positioning device comprises a clip-in shell fragment or reverse tapered teeth;
- a sleeve having a front having a positioning part, plate, and joining screw guide hole and another hole, wherein said another hole has step shaped large and small circular grooves; and
- a hollow safety casing with a connecting part and a sleeve.

6. The signal plug as claimed in claim 5, wherein the sleeve is threaded, allowing the plug and the safety casing to be joined to the thread on the sleeve.

7. The signal plug as claimed in claim 5, wherein the inside of the safety casing joining part is threaded allowing the front of the sleeve to be screwed to it.

* * * * *